US005286126A

United States Patent [19]

Harris et al.

[11] Patent Number: 5,286,126

[45] Date of Patent: Feb. 15, 1994

[54] PUSH-UP PACKAGE

[75] Inventors: Dennis Harris, Scottsdale; Ronald General, Phoenix, both of Ariz.

[73] Assignee: GHS Products, Inc., Phoenix, Ariz.

[21] Appl. No.: 958,698

[22] Filed: Oct. 9, 1992

[51] Int. Cl.[5] ..... A45D 40/02

[52] U.S. Cl. ..... 401/82; 401/87; 401/88; 401/98

[58] Field of Search ..... 401/82, 84, 85, 88, 401/98, 52, 87

[56] References Cited

U.S. PATENT DOCUMENTS

| | | | |
|---|---|---|---|
| 1,969,331 | 8/1934 | Small | 401/82 |
| 2,509,536 | 5/1950 | Spender | 401/82 X |
| 2,626,847 | 1/1953 | Brown | 401/82 X |
| 4,139,311 | 2/1979 | Lorscheidt | 401/82 X |
| 4,621,935 | 11/1986 | Sussman | 401/82 |

FOREIGN PATENT DOCUMENTS

| | | | |
|---|---|---|---|
| 681439 | 10/1952 | United Kingdom | 401/82 |

*Primary Examiner*—Danton D. DeMille
*Attorney, Agent, or Firm*—LaValle D. Ptak

[57] ABSTRACT

A package for dispensing solid products, such as solid crystal deodorant, includes a first hollow main body portion having a uniform cross section throughout its length. Both ends of the package are open; and a slide member is located within the main body portion. The bottom end of the main body portion of the package has an inwardly turned flange to prevent the movement of the slide member outwardly from the main body portion through the bottom end. The solid crystal deodorant is mounted on the slide member, and is configured to freely move from the bottom end of the main body portion outwardly through the upper end. Drain holes are placed through the slide member to permit fluid, such as water, to pass downwardly from the sides of the crystal deodorant and out through the holes when the package is stored in an upright position. A chamber in the slide member is filled with a sponge-like material for receiving fluid which passes from the crystal deodorant through the holes in the slide member.

8 Claims, 1 Drawing Sheet

PUSH-UP PACKAGE

BACKGROUND

A number of personal care products, which are solid at room temperature, are packaged in tubular containers constructed to expose a small amount of the product at the open upper end of the container. Typically, these containers have a cap over the open end to enclose the product when it is stored or not in use. Products of this type typically are lipstick, stick deodorant, eye color, facial blushes and the like. The typical containers for these products usually have the product attached to or mounted on a lower platform, which is moved up and down in the main hollow container by means of a rotational screw-like apparatus. The product is moved upwardly beyond the upper edge of the main container when it is to be used. Some of these containers permit the product to be retracted back into the container when it is not in use. Most products of the type mentioned above, while they are solid at room temperature, are somewhat soft, of a wax-like consistency.

None of the products of the prior art, which are mentioned above and which are known to applicant, however, are intended to be wetted with water prior to their use. Most of them contain a substantial amount of moisture, inherently bound into the product; so that external application of water to permit use of the product is not required. In the field of personal deodorants, however, solid rock-like crystal deodorants are gaining increasing acceptance. These crystal deodorants are made in a variety of shapes. To use them, the user either immerses them briefly in water, or places them under running water from a tap. The crystal then is rubbed over the area of the body to which the deodorant is to be applied. After use, the still wet crystal typically is placed on a sponge or in a storage container, where it is allowed to dry out. When such crystal deodorants are wet, they tend to be somewhat slippery, and sometimes slip out of the hands of the user. Because they are brittle, if they fall onto a hard counter top surface or a hard floor, parts may chip off, or the crystal may shatter.

It is desirable to provide a push-up container for use with solid crystal deodorants, which overcomes the handling disadvantages of solid crystal deodorants and permits use of such deodorants in a uniquely designed push-up package.

SUMMARY OF THE INVENTION

It is an object of this invention to provide an improved package for solid products.

It is an additional object of this invention to provide an improved push-up package for dispensing product.

It is another object of this invention to provide an improved push-up package for solid products such as solid crystal deodorants.

It is a further object of this invention to provide an improved push-up package for solid product, which has a provision for draining away moisture from the product after use.

In accordance with a preferred embodiment of the invention, a package for a solid product includes a hollow main body portion, which has a uniform cross section across its length. The main body portion of the package is open at least at one end; and a slide member is located within the body portion. The slide member is configured to permit movement in the main body portion from one end to the other. The main body portion of the package also is configured at one end to inhibit the slide member from moving past that one end; and the slide member is configured to permit fluid on a solid product carried by it to pass through the slide member.

DETAILED DESCRIPTION

Figure 1:
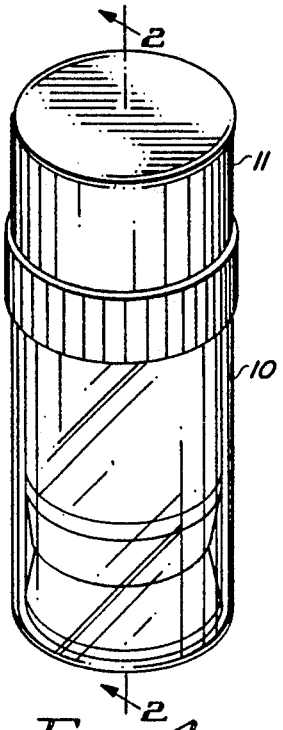
FIG. 1 is a perspective view of a container in accordance with a preferred embodiment of the invention.

Reference now should be made to the drawing, in which the same reference numbers are used in the different figures to designate the same components.

Figure 2:
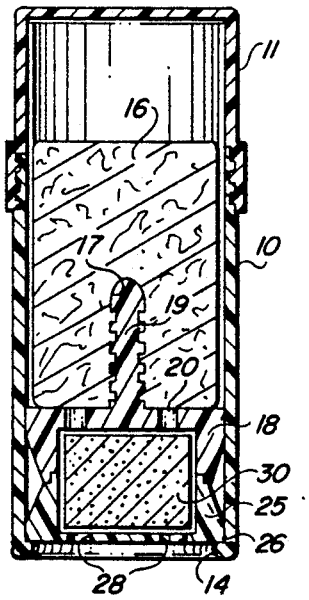
FIG. 2 is a cross-sectional view taken along the line 2—2 of FIG. 1.

FIG. 1 is a perspective view of a container which is used in conjunction with a preferred embodiment of the invention. The container comprises a lower, hollow cylindrical main body portion 10, which is closed at its top by a cap 11. In FIG. 2, a cross section of this embodiment shows details of the structure of both the package comprising the main body portion 10 and the cap 11, as well as the internal parts of the package along with a cylindrically-shaped solid crystal deodorant 16, which is placed in the package.

Figure 3:
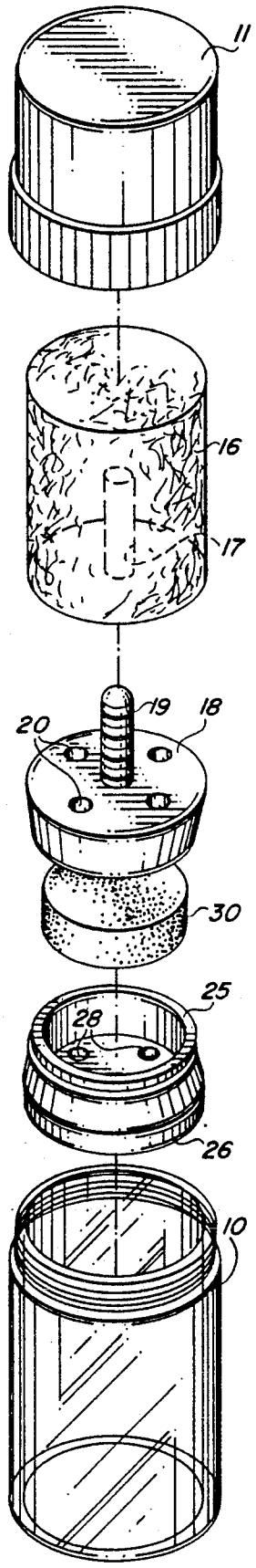
FIG. 3 is an exploded view of the embodiment shown in FIGS. 1 and 2.

The package shown in FIGS. 1, 2 and 3 is a "push-up" package; and the bottom of the cylinder 10 is open, with an inwardly turned flange 14 in it. The package includes a two-piece slide member comprised of an upper section 18 and a lower section 25, which fit together to form a hollow cavity in which a sponge 30 or other suitable water absorbent material is placed. At least the lower outer edge 26 of the lower portion 25 of the slide member frictionally engages the interior wall of the circular cylinder 10 to hold the slide member in place when it has been partially extended upward (as shown in FIGS. 1 and 2) in the housing 10.

The solid crystal deodorant cylinder 16 has a hole 17 located on its axis and extending part way into the cylinder 16 from the bottom. A frictional projection 19, which is integrally formed with the top portion 18 of the slide member, is forced into the hole 17 to tightly hold the cylinder 16 in place on the top surface of the upper part 18 of the slide member.

As is well known, when a solid crystal deodorant, such as the deodorant 16, is used, it is first wetted with water by holding it under a running tap or immersing it in a sink filled with water. The deodorant then is used in a conventional manner by applying it to the body where it is desired. After use, the cap 11 typically is placed on the top of the cylinder 10; but the deodorant 16 still has excess water on it, which must be allowed to drain away or dry out.

If water is left on the crystal 16, or if the crystal is permitted to have a portion submerged in water, it will eventually deteriorate by becoming soft. When this happens, the crystal may be unusable in the manner intended. To prevent this from happening, a number of holes 20 are formed through the top surface of the upper portion 18 of the slide member slide member 18 into the cavity in which the sponge 30 is located. A similar set of holes 28 are formed through the bottom of the lower part of the slide member 25; so that water may flow down the sides of the crystal cylinder 16, through the holes 20 and into the sponge 30.

If a relatively small amount of water passes through the holes 20 to the sponge 30, the sponge holds that water, which then is slowly evaporated through the holes 28; so that no puddling of water occurs beneath the hollow bottom of the cylinder 10 when the package is stored or not in use. If a relatively large amount of water, however, is present, it is possible for the sponge 30 to become saturated. When this occurs, the remainder of the water then flows outwardly through the holes 28. In either event, no puddling of the water on the bottom of the crystal deodorant cylinder 16 occurs; and it is preserved for repeated use.

It should be noted, from an examination of FIG. 2, that the cylinder 16 has an external diameter which is slightly less than the internal diameter of the cylinder 10. The distance between the external diameter of the crystal deodorant 16 and the internal diameter of the cylinder 10 forming the main body portion of the package is selected to be sufficient to permit water to pass downwardly past the outer edge of the cylinder 16 and onto the upper surface of the upper slide member portion 18.

The structure which is illustrated in FIGS. 2 and 3 is selected to employ sufficient frictional fit between the outer edges of the upper and lower portions 18 and 25 of the slide member to cause it to remain in place when it is pushed upwardly by a finger through the hole in the bottom of the cylinder 10 by applying pressure to the bottom of the lower portion 25 of the slide member. By applying pressure to the top of the crystal deodorant cylinder 16, the entire block may be depressed downwardly into the cylinder 10 until the outer edge 26 of the member 25 engages the flange 14. The flange 14 then prevents the slide member 18/25 from being pushed out of the main body portion 10 through the bottom, as viewed in FIGS. 1, 2 and 3.

Figure 4:
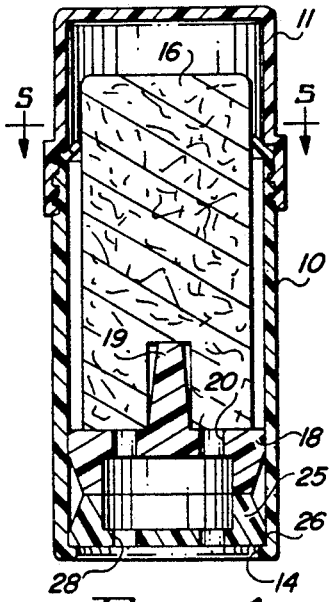
FIG. 4 is a cross-sectional view of an alternative to the embodiment shown in FIG. 2.
Figure 5:
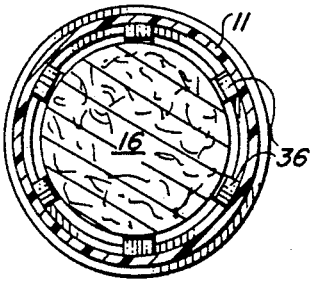
FIG. 5 is a cross-sectional view taken along the line 5—5 of FIG. 4.

Reference now should be made to FIG. 4, which is a variation of the device shown in FIG. 2. The device of FIG. 4 is identical to the one of FIG. 2, with the exception that a number of short, inwardly turned fingers 36 are placed around the upper edge of the cylinder 10 and extend inwardly and upwardly at an angle toward the central axis of the package. These fingers 36 engage the sides of the crystal deodorant cylinder 16 to cause it to be centrally positioned in the cylinder 10 as it is pushed upwardly in the manner described previously. The fingers 36, however, also tend to inhibit downward motion as a result of pressure applied to the top of the crystal deodorant cylinder 16. Thus, once the deodorant 16 has been pushed upwardly to some position past the resilient fingers 36, it is held in place by the fingers 36, and cannot be pushed back down toward the bottom of the main body portion 10 of the package unless substantial force is applied to it. In all other respects, the embodiment of FIGS. 4 and 5 operates in the same manner as the embodiment of FIGS. 1 through 3, described above.

Figure 6:
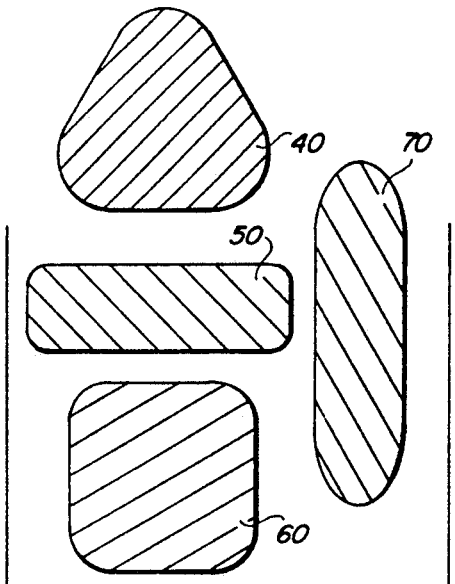
FIG. 6 is a grouping of alternative shapes, which may be used in place of the shapes of the embodiments shown in FIGS. 1 through 5.

It is to be noted that the internal diameter of the cylinder 10 and the external diameter of the crystal deodorant 16 both are of uniform cross section throughout their length. This permits the slide member 18/25 to be moved from the lowermost location, shown in FIGS. 2 and 4, to its uppermost location out of the top open end of the main body portion 10, with substantially the same frictional force throughout its distance of travel. It is not necessary, however, for the main body portion 10 and the crystal deodorant 16 to be of circular cross section. FIG. 6 illustrates four other possible cross-sectional configurations 40, 50, 60 and 70, which may be used in place of the circular cross-sectional configuration which is illustrated in FIGS. 1 through 5.

The foregoing description of the preferred embodiment of the invention is to be considered illustrative, and not as limiting. For example, the liquid which to drains from the crystal 16 into the cavity 30 may drain through grooves around the outside edge of the upper portion 18 of the slide member, in place of the holes 20 which have been shown. In addition, the number of holes 20 and 28 which are illustrated can be varied in accordance with the particular design objectives for a specific application of the invention. In addition, while the sponge 30 performs a useful crystal could be permitted to drain outwardly from the open bottom of the hollow main housing member 10. Other changes and modifications will occur to those skilled in the art, without departing from the true scope of the invention.

We claim:

1. A package for solid product including in combination:

a hollow main body portion having first and second ends and having a uniform cross section across the length thereof between said first and second ends, said main body portion open on the first and second ends thereof;

a slide member with a hollow chamber therein located within said main body portion to frictionally engage the interior of said main body portion and configured to permit movement therein from the second end of said main body portion to the first end thereof, with the opening in the second end of said main body portion being large enough to permit the insertion of the finger of a person therein to move said slide member toward the first end of said main body portion away from the second end thereof;

blocking means at the second end of said main body portion for inhibiting said slide member from moving past the second end of said main body portion;

means on said slide member for holding a solid product thereon for movement therewith within said main body portion;

fluid absorption material in the hollow chamber in said slide member for absorbing fluids; and means in said slide member for permitting the passage of fluid therethrough to the hollow chamber in said slide member.

2. The combination according to claim 1 further including a removable cap for the first end of said main body portion.

3. The combination according to claim 2 wherein said blocking means comprises an inwardly turned flange on said second end of said main body portion.

4. A package for solid product including in combination;

a hollow main body portion having first and second ends and having a uniform cross section across the length thereof between said first and second ends, said main body portion open on at least the first end thereof;

a two-part slide member having first and second parts located within said main body portion and configured to permit movement therein from the second end of said main body portion to the first end thereof, said first part having means thereon for holding a solid product for movement within said main body portion, and said second part being releaseably attached to said first part and located between the first part thereof and the second end of said main body portion, with said first and second parts configured to form a hollow chamber therebetween when said first and second parts are releaseably interconnected together, with apertures through said first part of said slide member for permitting the passage of fluid through said apertures into said hollow chamber, wherein said second part of said slide member further has apertures therethrough to permit fluid in the chamber formed between said first and second parts of said slide member to flow therethrough toward the second end of said main body portion; and blocking means at the second end of said main body portion for inhibiting said slide member from moving past the second end of said main body portion.

5. The combination according to claim wherein the second end of said main body portion is open.

6. The combination according to claim 5 wherein the opening in the second end of said main body portion is large enough to permit the insertion of the finger of a person therein to move said slide member toward the first end of said main body portion away from the second end thereof.

7. The combination according to claim 6 wherein said blocking means comprises an inwardly turned flange on said second end of said main body portion.

8. A package for solid product including in combination:

a hollow main body portion having first and second ends and having a uniform cross section across the length thereof between said first and second ends, said main body portion open on at least at the first end thereof;

a slide member, with a hollow chamber therein, located within said main body portion and configured to permit movement therein from the second end of said main body portion to the first end thereof;

blocking means at the second end of said main body portion for inhibiting said slide member form moving past the second end of said main body portion;

means on said slide member for holding a solid product thereon for movement therewith within said main body portion;

means in said slide member for permitting the passage of fluid therethrough to said hollow chamber; and fluid absorption material placed in said hollow chamber in said slide member for absorbing fluid.

* * * * *